US007073810B2

(12) United States Patent
Wilson

(10) Patent No.: US 7,073,810 B2
(45) Date of Patent: Jul. 11, 2006

(54) SKI WITH TUNNEL AND ENHANCED EDGES

(76) Inventor: Anton F. Wilson, 774 Mays Blvd., #10, PMB 302, Incline Village, NV (US) 89451

( * ) Notice: Subject to any disclaimer, the term of this patent is extended or adjusted under 35 U.S.C. 154(b) by 63 days.

(21) Appl. No.: 10/603,248

(22) Filed: Jun. 25, 2003

(65) Prior Publication Data

US 2004/0262885 A1 Dec. 30, 2004

(51) Int. Cl.
*A63C 5/04* (2006.01)

(52) U.S. Cl. ..... 280/609; 280/608; 280/601; 280/607

(58) Field of Classification Search ..... 280/601, 280/607, 608, 609, 28, 14.21, 14.22, 602, 280/610, 11.18
See application file for complete search history.

(56) References Cited

U.S. PATENT DOCUMENTS

| | | | | |
|---|---|---|---|---|
| 382,254 | A | 5/1888 | Conradson | |
| 3,063,728 | A | 11/1962 | Patterson | |
| 3,099,025 | A * | 7/1963 | Merkley et al. | 441/68 |
| 3,304,095 | A | 2/1967 | Carlton | |
| 3,395,411 | A * | 8/1968 | Pope, Jr. et al. | 441/68 |
| 3,503,621 | A * | 3/1970 | Schmidt et al. | 280/610 |
| 4,083,577 | A | 4/1978 | Ford | |
| 4,524,984 | A * | 6/1985 | Axelson | 280/18 |
| 4,688,821 | A | 8/1987 | Meatto et al. | |
| 4,700,967 | A | 10/1987 | Meatto et al. | |
| 4,715,612 | A | 12/1987 | Fels et al. | |
| 4,752,082 | A * | 6/1988 | Sevington | 280/608 |
| 4,778,197 | A * | 10/1988 | Floreani | 280/602 |
| 4,838,571 | A * | 6/1989 | Sevington | 280/608 |
| 4,858,944 | A * | 8/1989 | Diard et al. | 280/609 |
| 4,957,304 | A | 9/1990 | Diard et al. | |
| 5,018,760 | A * | 5/1991 | Remondet | 280/609 |
| 5,040,818 | A | 8/1991 | Metheny | |
| 5,083,810 | A | 1/1992 | Minidis | |
| 5,145,201 | A | 9/1992 | Metheny | |
| 5,158,318 | A | 10/1992 | Dittmar | |
| 5,221,104 | A * | 6/1993 | Bejean et al. | 280/604 |
| 5,242,187 | A | 9/1993 | Diard et al. | |
| 5,303,949 | A | 4/1994 | Harper et al. | |
| 5,340,144 | A * | 8/1994 | Eleneke | 280/609 |
| 5,360,229 | A | 11/1994 | Arduin et al. | |
| 5,405,161 | A | 4/1995 | Petkov | |
| 5,462,304 | A * | 10/1995 | Nyman | 280/609 |

(Continued)

FOREIGN PATENT DOCUMENTS

DE 88 06 015.2 6/1988

OTHER PUBLICATIONS

Pages (2) from ELAN X-Tech Series, 1998-1999 Ski Brochure including Stealth and Phantom ski description.

*Primary Examiner*—Christopher P. Ellis
*Assistant Examiner*—Kelly E Campbell
(74) *Attorney, Agent, or Firm*—Fish & Richardson P.C.

(57) ABSTRACT

A snow ski has at least one channel formed in the running surface to expose the inner sides of the ski edges for translating the force exerted by the ski during a turn and creating positive engagement with the skiing surface. The channel may extend the length of the ski or only a portion thereof. The channel forms edge tips on the ski edges where the inner sides are exposed. The edge tips may have different shapes to improve the bite on the skiing surface.

20 Claims, 7 Drawing Sheets

U.S. PATENT DOCUMENTS 5,553,884 A 9/1996 Abondance
5,647,353 A 7/1997 Juhasz
5,671,939 A 9/1997 Pineau
5,687,983 A * 11/1997 Feketa et al. ..... 280/609
5,727,807 A 3/1998 Kraft et al.
5,820,154 A 10/1998 Howe
5,836,604 A 11/1998 Plegay
5,871,223 A 2/1999 Zanco
5,871,224 A * 2/1999 Vance ..... 280/608
5,876,056 A 3/1999 Karlsen
5,915,719 A 6/1999 Rauvois
5,927,743 A 7/1999 Mantel
5,984,344 A 11/1999 Harsanyi et al.
6,062,585 A * 5/2000 Hess ..... 280/608
6,079,746 A 6/2000 Olsen
6,131,939 A * 10/2000 Fels ..... 280/601
6,158,747 A 12/2000 Magnani
6,182,998 B1 2/2001 Hugye et al.
6,193,262 B1 2/2001 Silva
6,217,055 B1 4/2001 Silva
6,224,085 B1 * 5/2001 Cruz ..... 280/609
6,227,558 B1 5/2001 Arduin et al.
6,241,272 B1 6/2001 Hammerle
6,244,616 B1 6/2001 Arduin et al.
6,257,612 B1 7/2001 Zanco et al.
6,257,620 B1 7/2001 Kenney
6,283,493 B1 9/2001 Arduin et al.
6,290,249 B1 9/2001 Wolf
6,315,317 B1 11/2001 Liard et al.
6,325,404 B1 12/2001 Liard et al.
6,357,782 B1 3/2002 Pieber et al.
6,367,173 B1 4/2002 Lancon
6,382,658 B1 5/2002 Stubblefield
6,394,482 B1 5/2002 Carlson
6,499,759 B1 12/2002 DeBorde et al.

* cited by examiner

SKI WITH TUNNEL AND ENHANCED EDGES

FIELD AND BACKGROUND OF THE INVENTION

The present invention relates generally to the field of snow skiing and in particular to a new and useful ski construction having increased traction and control in packed and icy snow.

The basic flat design of ski running surfaces dates back more than one hundred years and is quite adequate for its initial intended purpose of floating on, or pushing against, powder snow and soft packed snow. As skiing evolved into a competitive and recreational sport, the typical ski terrain shifted from powder and soft-pack to predominantly groomed hard packed snow and sometimes ice. In order to deal with these conditions, virtually all modern skis have hardened steel edges running from front to back along both left and right sides of the bottom surface. These edges are machine ground along with the plastic bottom of the ski to form one smooth continuous surface.

Steel edges may be superfluous in loose powder conditions but when hard-pack snow and ice are encountered, the skier must angle the ski such that one of the two steel edges will "bite" into the hard surface. Otherwise, the skier cannot create a controlling force through the friction of a skid. Similarly, snow-glider type skiers and hyper-carving skiers must create even more extreme positive engagement with the snow surface so that the edge properly "tracks" through the hard surface without skidding. The blade geometry or configuration of an ice skate is most effective for digging into a surface. In contrast, the configuration of a conventional ski is extremely counterproductive to this important function.

FIGS. 1–4B are provided to illustrate the principles on which the invention herein is based.

FIG. 1 illustrates a rear view of an ice skate 2 going straight on the surface 5. Arrow F indicates that the force exerted by the skater (primarily in the form of gravity, or weight) is directed completely aligned with the skate blade 1, perpendicular to the skating surface 5. The pressure exerted on the ice is extremely high, mainly because the blade 1 is narrow and presents very little surface area to the ice 5, thereby forcing the blade 1 to bit into the ice 5.

As the skater begins to bank into a left turn, the blade 1 naturally angles to the left, as illustrated by FIG. 2. The skater's force F is now directed at an oblique angle θ to the skating surface 5, and has two components—a horizontal (centrifugal) force CF and a downward force W. The resulting centrifugal force CF is directed to the right, but the sharp edge of the blade 1 is angled in a manner to "dig into" the ice of the skating surface 5, thus preventing any unwanted skidding. The ice provides an equal force against the force F produced by the skater. Newton's Law thereby requires the skater to turn to the left, rather than skid to the right.

It is important to differentiate this positive dig angle from a negative slide or skid angle. When an acute angle θ exists between the blade 1 and the surface 5 in the intended direction of movement (the force is directed opposite to the movement), a dig angle is achieved. If the blade 1 is at an acute angle to the surface 5 to the side opposite the intended direction of movement, a skid angle is produced. For example, consider sliding the skate blade 1 of FIG. 2 across the surface toward the left; clearly the blade 1 will easily move to the left as it slides across the surface 5. In contrast, trying to push the skate blade 1 to the right while at the same angle will be very frustrating, as it digs into the ice, preventing movement to the right.

Thus, an ice skating blade 1 is normally always operating in a dig angle mode, and never at a skid angle, because the skater's force is always directed from the side of the blade 1 forming the acute angle with the surface 5. Moreover, as the turn gets tighter and/or faster, the angle θ decreases proportionately, as does the dig angle of the blade. Thus the ice skating blade naturally assumes a proportionately appropriate dig angle to the ice surface in order to always cope successfully with the outward centrifugal force. This is why an ice skater rarely skids out during a turn.

The same analysis of a ski turn reveals the problem that plagues all skiers attempting to turn on a hard packed or icy surface 5.

FIG. 3 illustrates a ski 4 going straight on a typical groomed hard packed surface 5. As with the skater, all of the skier's force F is directed downward at the skiing surface 5, but through the flat running surface 4*a* of the ski, rather than a blade. Unlike a skate, the running surface 4*a* of the ski presents a large contact surface area to the skiing surface 5. This dissipates the total force F, so that the pressure exerted against the skiing surface (such as measured in p.s.i.) at any portion is significantly less, relative to the force exerted by the skater. The skier is effectively in an ultimate skid or slide condition as the angle between the edges 3*a* and 3*b* and surface 5 is zero.

FIG. 4A illustrates the right ski 4 of a skier making a left turn by lifting the right 3*b* edge and placing more weight on the left edge 3*a*. As should be clear, the skier remains in a skid angle α with the snow surface 5 instead of forming a dig angle θ. This is so because ski running surface 4*a* is roughly equivalent to the side of skate blade 1 in this analysis, and the acute angle α is formed in the side opposite the intended movement. Centrifugal force CF will easily overcome friction between the edge 3*a* and surface 5, causing a skid, rather than dig. This is especially true when the ski 4 forms the usual low skid angle α occurring during a ski turn. It is nearly impossible for a conventional skier to positively engage the snow surface 5 in a dig angle because the ski 4 and ski edges 3*a*, 3*b* simply do not permit creation of a dig angle during a turn.

This is why the majority of recreational skiers never come close to achieving the positively engaged carved turn of the ice skater; every attempt to edge the ski results in an extreme skid angle and the inevitable skid. Thus virtually all recreational skiers are skid skiers who attempt to use the friction of the skid to control speed and direction. Some control is possible at all due to skid friction generated between the edge 3*a* and ski running surface 4*a* with the snow surface 5.

FIGS. 1–4B should also make clear why a recreational skier finds carving so difficult when it is understood how an expert skier or ski racer achieves this feat. After significant training and with great strength, the expert skier takes a giant leap of faith past the extreme skid angle and angulates the ankles, knees, hips, and pelvis to place the active ski edge 3*a* almost vertical to the snow surface 5. This angulation is illustrated in FIG. 4B.

It is important to realize that even with the most extreme angulation, the expert skier can never achieve a positive engagement dig angle but only reduce the skid angle to a minimum. Since even the expert skier can never achieve a dig angle it is imperative to maximize the grip of this compromised edge angle with additional down force. This is done in a manner similar to Indy-style racecars that use wings to create additional down force on the tires, which results in greater grip and cornering ability.

The contortions of extreme angulation are mandated not only to get the ski almost vertical in order to minimize the skid angle, but also to create this additional down force on the edge that prevents skidding out. The extreme bending of the torso at the waist, combined with the legs in a position almost parallel with the snow surface, creates a clockwise torque that is balanced by greater downward force on the ski edges. The entire weight of the skier's body, plus the centrifugal force and torque of the turn, must be supported by the lateral abductors and adductors of the leg muscles as well as the oblique and abdominal muscle structure of the torso/hips while in this angulated contortion. These are muscle groups that are rarely, if ever, used by the average person or recreational skier. It is ludicrous to expect anyone other than a highly trained athlete to achieve this great feat of strength and agility.

In contrast, the ice skater is not required to master these strenuous feats of contortion because the skate blade is always at a dig angle and does not require additional angulation or down force to prevent skidding. The simple and casual turn position of a skater permits the skater to keep their body in a natural standing position parallel to the forces during turning. There are no contortions or need for inordinate strength from any muscles. The skater merely leans into the turn and stands up in a normal fashion against the turning forces.

Some skis and snowboards have been proposed having different running surface configurations for a variety of reasons.

U.S. Pat. No. 4,083,577 describes a ski having a convex running surface and blade edges extending along the sides of the ski adjacent the boot bindings. The blade edges extend to about the depth of the convex surface apex. The blades are provided to enhance the turning and gripping and resemble ice skate blades, but are formed with a single edge. The running surface lacks a flat area.

U.S. Pat. No. 3,304,095 teaches a very specific configuration for a pair of skis. The skis have a transversely sloped running surface from the inner edges toward the outer edges. The running surface of each ski is inclined upwardly from the inner edge toward the outer edge. The running surface slopes sharply downward near the outer edge, from which point a second upwardly inclined surface joins the outer edge. The particular running surface configuration provides a triangular channel in the running surface of each ski, the greatest depth of which is adjacent the outer edge of the ski.

U.S. Pat. No. 5,462,304 discloses a snowboard having interchangeable, dual-acting edges which extend continuously along the outside length of the active board edge. The interchangeable edges are provided to make repair and maintenance easier, as well as providing a simple method for adapting the snowboard to the skiing surface conditions. The interchangeable dual-acting edges each have a pair of control edges, one elevated above the other. The lower, first edge is oriented facing inwardly toward the board center, while the upper, second edge faces outwardly. The first edge contacts the skiing surface during level, flat riding, while the board be rolled onto the second, elevated edge in a sharp turn. The second edges act similar to a governor and provide stability in sharp turns so that the snowboarder can return to the first, lower edges without falling. The orientation of the edges is arranged to prevent the second edges from creating instability when the board is flat.

A snowboard with a longitudinal tunnel along the length of the running surface is taught by U.S. Pat. No. 6,224,085. Several orthogonal protrusions are mounted inside the tunnel for contacting the snow surface. Flat sides with conventional outer edges are provided on each side of the tunnel. In use, the protrusions are intended to contact snow passing through the tunnel to provide better turning control than the conventional outer edges alone.

U.S. Pat. No. 3,503,621 illustrates a fiber glass composite ski having a small groove along the center of the running surface near the front end of the ski. The ski body is wider on either side of the groove that the width of the groove. The purpose of the groove is not revealed in the patent.

U.S. Pat. Nos. 5,040,818 and 5,145,201 both teach a snow mobile ski runner having a center running blade and elongated cylindrical wear bar mounted to the bottom middle of a center concave portion and a pair of horizontally extending concave surfaces vertically offset above the center concave portion. The horizontally extending concave surfaces are provided as primary steering surfaces and extend along the length of the ski on each side. The center wear bar is provided for when the ski is running on icy surfaces.

The inventor herein has proposed a new type of ski called a snow glider for producing positive engagement with the snow using an extremely narrow ski. The snow glider is described in co-pending application Ser. No. 10/286,643 filed Oct. 31, 2002. Generally, the snow glider relies upon a narrow waist section in a primary ski having a conventional shape running surface alone or in combination with a secondary edge mounted above the primary ski to provide enhanced turning.

Clearly, skiing could be made easier, especially for casual recreational skiers, if a ski were available which has edges that produce positive engagement, or dig angles, during turns as opposed to skid angles.

SUMMARY OF THE INVENTION

It is an object of the present invention to provide a snow ski, snow glider or snow board having improved carving and turning characteristics.

It is a further objection of the invention to provide a snow ski, snow glider or snow board with edges which positively engage the snow surface during a turn, rather than simply skid across the surface.

Yet another object of the invention is to provide a snow ski, snow glider or snow board for producing dig angles during turns with only mild movements and without resort to expert techniques such as angulation.

A still further object of the invention is to provide a snow ski, snow glider or snow board easily controlled by even the most casual user.

In accordance with these objects, a ski of the invention has a ski edge geometry and carving performance similar to that of an ice skate. One or more recesses or channels are introduced in the bottom running surface to expose the inner side of the ski edges. The channels run alongside the steel side edges of the ski. The running surface includes flat sections for preventing both edges from digging in at once and stopping a skier's forward movement.

The presence of the channel exposes an inner side of the ski edge, so that during a turn, the ski edge acts like a skate blade and produces a dig angle with the snow surface, compared to a skid angle produced by the plane of the running surface between the ski edges.

Several embodiments of the ski edge and channel shapes are provided which have varying degrees of effectiveness in different types of skiing conditions.

All types of ski equipment are envisioned as using the channels and exposed ski edges to provide greatly enhanced control of the equipment and change the way in which snow sports are experienced by even casual participants.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

As used herein, the term ski equipment or snow ski or ski is intended to encompass other similar equipment used for sliding across snow and/or ice, including snow boards, hyper carve skis, and snow gliders. Snow gliders were created by the inventor herein and are described in pending U.S. patent application Ser. No. 10/286,643 filed Oct. 31, 2002; generally, snow gliders are similar to a snow skate, and long like a snow ski but with narrower widths.

Typically, one snow ski of a pair is equipped on each of a skier's feet using ski boots and bindings in a customary and known manner. While a single snow ski may be shown or discussed, the same details are intended to apply to the other snow ski of a matched pair, when normally used as a pair. Accordingly, the descriptions herein should be interpreted to apply to the second snow ski in a pair, as well, unless noted otherwise.

Figure 5:
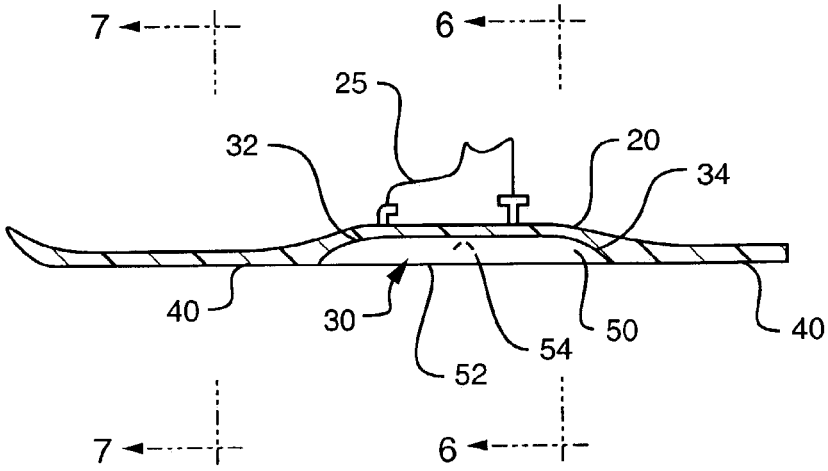
FIG. 5 is a sectional side elevation view of a ski of the invention viewed from the longitudinal centerline of the ski.

Referring now to the drawings, in which like reference numerals are used to refer to the same or similar elements, FIG. 5 shows a ski 20 having a hollow or channel 30 formed in the running surface 40 beneath the area of the boot binding 25. The channel 30 has sloped front and rear ends 32, 34 which preferably gradually join the deepest part or ceiling of the channel 30 with the running surface 40. The depiction of channel 30 and the curvature of ski 20 are exaggerated in the drawings to better illustrate the invention. The sides of the channel 30 are closed by ski edges 50.

Figure 6:
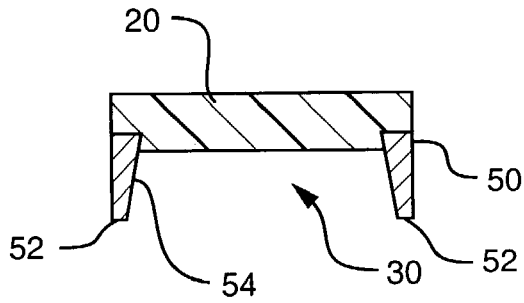
FIG. 6 is an end sectional view of the ski of FIG. 5 taken along line 6—6.

FIG. 6 illustrates how the ski edges 50 form the sides of the channel 30. The ski edges 50 are preferably made of steel, as is commonly known to do for the edges of conventional skis. The ski edges 50 preferably extend along the entire length of ski 20 except at the extreme tip and tail, but may be shorter or longer.

Unlike conventional skis, however, the ski edges 50 adjacent the channel 30 are exposed on two or three sides, rather than just one or two, so that the inner side 54 is available to contact the snow. The bottom surface of the ski 20 adjacent the edges is recessed and does not contact the snow in hardpack or icy conditions. All of the downward force of the skier is supported only by the edge 50 in the area of the channel 30.

Figure 1:
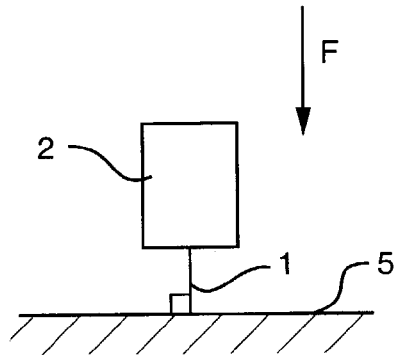
FIG. 1 is a force diagram for an ice skate moving into the page.
Figure 2:
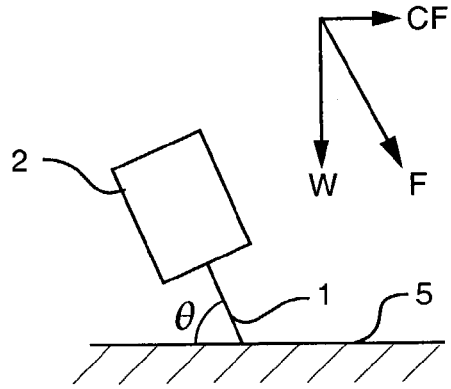
FIG. 2 is a force diagram illustrating the ice skate turning to the left while moving into the page.
Figure 3:
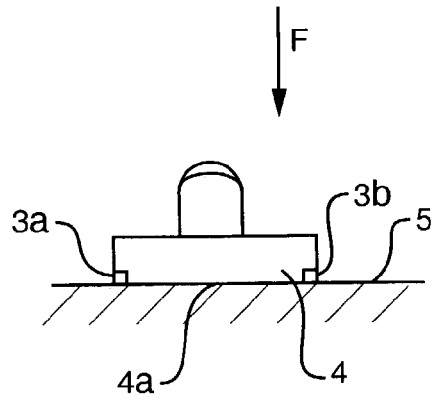
FIG. 3 is a force diagram for a snow ski moving into the page.
Figure 4A:
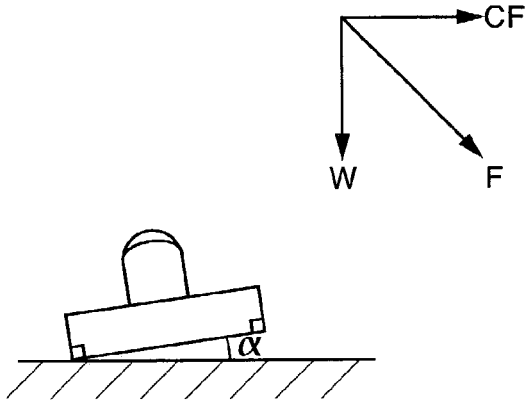
FIG. 4A is a force diagram illustrating the snow ski turning left while moving into the page.
Figure 4B:
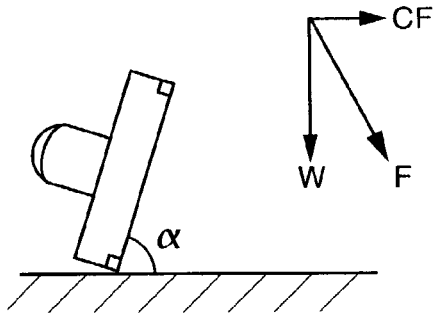
FIG. 4B is a force diagram illustrating an expert skier using the snow ski of FIG. 4A turning left while moving into the page.

As a result, the ski edges 50 at the channel 30 function similarly to ice skate blades during a turn because they are exposed on both the outer side and inner side 54, without additional surface to impede penetration. That is, the force diagram becomes like that of FIG. 2, rather than FIG. 4, as the ski edge 50 acts like the ice skate blade of FIGS. 1 and 2. The skier's force in a turn is applied to the skiing surface through edge tip 52 and inner side 54, rather than through a corner of the edge 50 and running surface 40. The exposed inner ski edge 54 effectively turns the forces applied by the skier to the skiing surface by 90° so that the ski edge 50 is positively engaged with the skiing surface at a dig angle of some degree.

Figure 7:
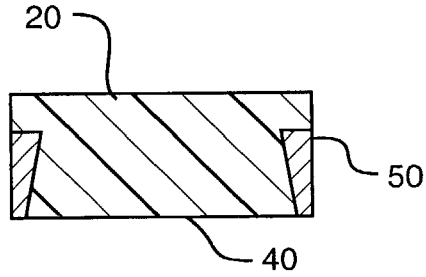
FIG. 7 is an end sectional view of the ski of FIG. 5 taken along line 7—7.

FIG. 7 shows the solid ski body 20 at the front end ahead of channel 30. At this location, ski edges 50 are exposed only on the outside and edge tip 52. Inner side 54 is mounted directly against ski body 20 and covered.

As illustrated in FIGS. 5–7, the channel 30 preferably extends through approximately the center third of the length of the ski 20, while running surfaces 40 of the front and rear thirds remain flat and smooth, and without channels. However, in alternate embodiments channel(s) may run from 5% to 100% of the length depending on the terrain surface and intended application. For example, a ski 20 may have a cross-section like that of FIGS. 9A–9C along its entire length when channel 30 extends the length of the ski 20.

Figure 8:
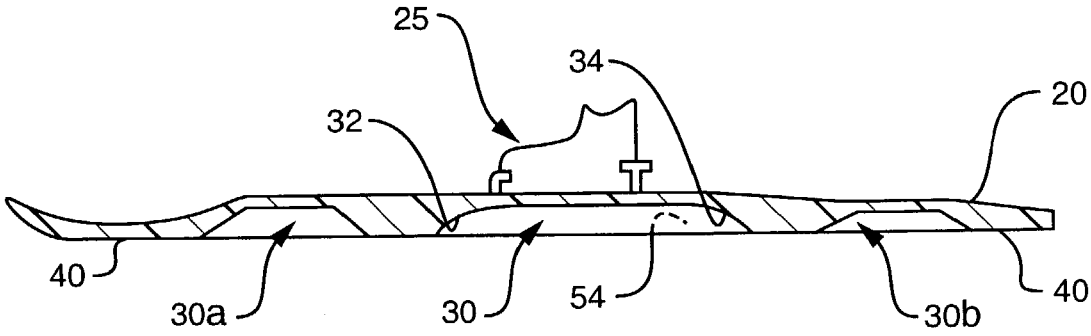
FIG. 8 is a sectional side elevation view of a second embodiment of the ski of FIG. 5 viewed from the longitudinal centerline of the ski.

As shown by FIG. 8, the channel 30 may be discontinuous, with discrete channels 30 formed in two or more areas along the length of the ski 20. For example, a second channel 30*a* can be formed near the front end or tip of the ski 20, and a third channel 30*b* formed near the rear or tail of the ski 20. The channels 30*a*, 30*b* may have the same or a different shape as the channel 30 under the boot binding area of the ski 20. In each case, the front and rear ends of the channels 30, 30*a*, 30*b* are sloped from the channel ceiling to the running surface 40. The channel ceiling is preferably flat.

In the preferred embodiment of FIG. 5, however, the front and rear thirds of the ski 20 have flat, smooth running surfaces 40. The flat running surfaces 40 provide lift and float in soft powder conditions, as well as keeping the two channeled edges 50 of the ski 20 from engaging the snow simultaneously while the ski 20 is flat against the snow surface, which would cause instability.

The ski 20 in the embodiment of FIG. 8 will provide additional turning power, as the forward and rear exposed ski edges 50 at channels 30*a*, 30*b* will grip the snow better during a turn.

Figure 9A:
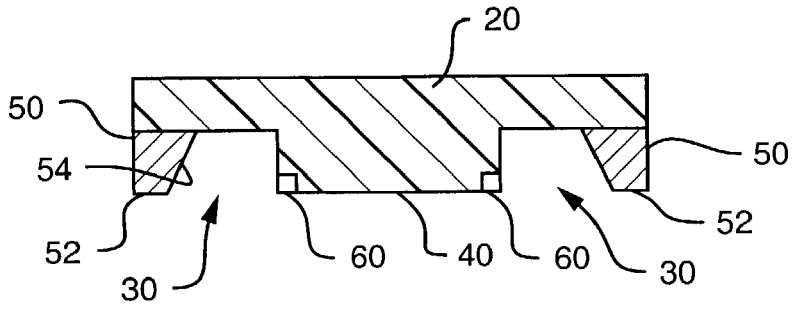
FIG. 9A is an end sectional view of an alternate channel shape for a ski of the invention.
Figure 9B:
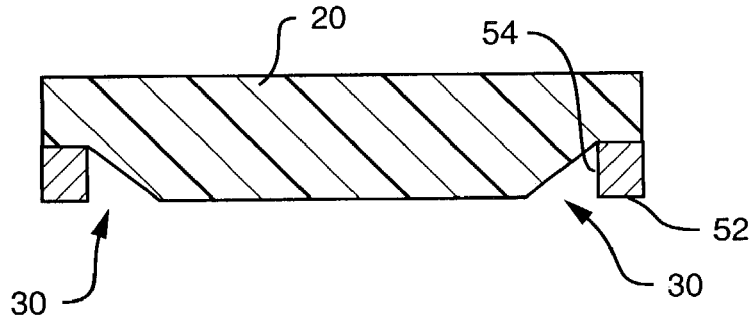
FIG. 9B is an end sectional view of a second alternative channel shape for a ski of the invention.
Figure 9C:
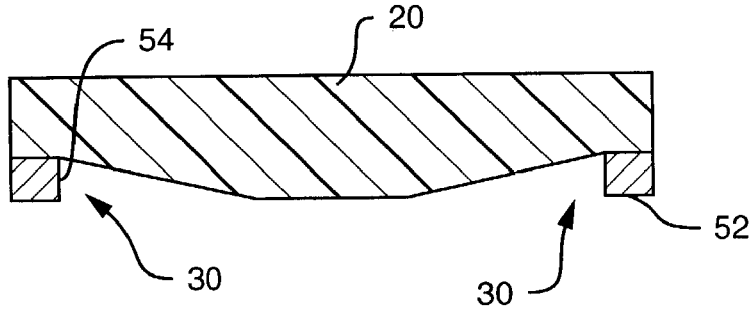
FIG. 9C is an end sectional view of a third alternate channel shape for a ski of the invention.

FIGS. 9A–9C show alternative embodiments in which the channel 30 is divided into two separate channels 30 in the running surface 40 on either side of the ski 20. As seen, the ski edges 50 each have exposed inner side 54 facing one of the channels 30 for contacting the snow surface. The running surface 40 is preferably flat, and may have second edges 60, as illustrated in FIG. 9A.

When second edges 60 are present, they are preferably formed as conventional ski edges, with the edge tip flush with the running surface 40 and inner side mounted against the ski 20. But, different shape edges can be used for second edges 60 as well, such as trapezoidal, triangular, L-shape covers, etc. Second edges 60 are used primarily for reinforcing the ski 20 material against damage during use, but also provide some engagement with the snow surface during a turn.

The channel width and depth can be of almost any size with the impact on carving ability being proportional. The width and depth of the channel 30 have a direct impact on the portion of ski edge inner side 54 that is exposed and can act like an ice skate blade. A shallow and narrow channel 30 will have only a minimal increase of "bite" on hard packed snow with a more significant bite on ice. In contrast, a deep and wide channel 30 will result in a tenacious grip on hard and soft packed snow as well as ice.

Figure 10A:
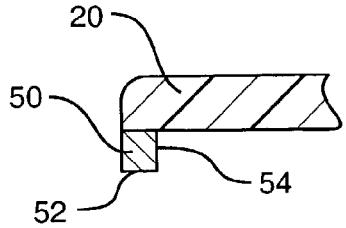
FIGS. 10A–10D are partial end sectional views of alternate ski edge configurations used with the invention.
Figure 10B:
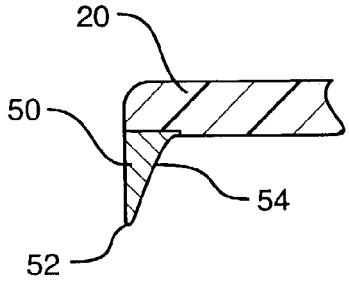
Figure 10C:
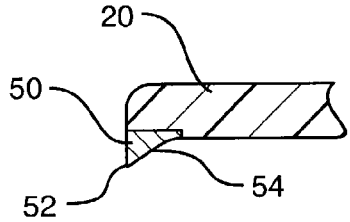
Figure 10D:
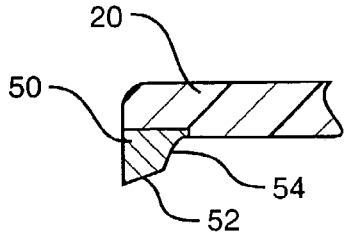
Figure 11:
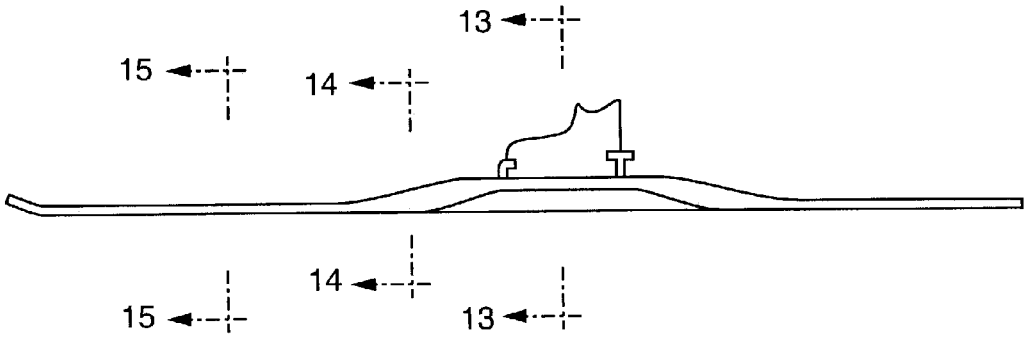
FIG. 11 is a side elevation view of a third embodiment of a ski according to the invention viewed from the longitudinal centerline of the ski.
Figure 12:
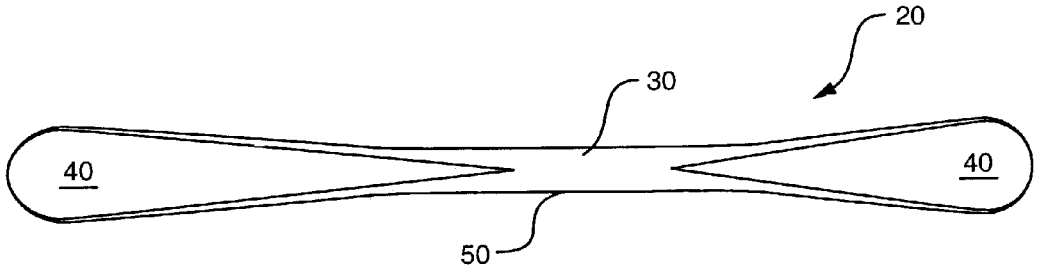
FIG. 12 is a bottom plan view of the ski of FIG. 11.

FIGS. 10A to 10D display different ski edge 50 and channel 30 configurations for use with the ski 20. While not shown, the other side of each exemplary ski 20 is typically, but not essentially identical. In certain instances, it may be beneficial to have a different edge configuration for the inner edge of a ski than the outer edge, where inner and outer are relative to the foot the ski is worn on. The ski edges 50 may have flat edge tips 54 as in FIGS. 10A and 10D, or more pointed edge tips 54 as in FIGS. 10B and 10C. The channel 30 may be formed as a rectangular or square shape as in FIG. 10A, or with the rounded side corners of FIGS. 10B and 10D. The channel 30 may be concave between side edges 50 as well, as illustrated by FIG. 10C.

The particular width of the ski edges 50 at the edge tip 54 will have a dramatic effect on the amount of grip or bite produced while turning on very hard packed and icy surfaces. An edge tip 52 width of about 2 mm, which is typical of a modern ski, in combination with the channel 30, will be quite effective on all but the iciest surfaces. Creating a narrower width with a thin chisel shape edge, such as in FIG. 10B, will dramatically improve grip and bite on hard ice. In such case, the edge tip may be as thin so as to nearly be a blade.

The channel 30 depth is preferably between 2 and 7 mm. The channel width and depth can also taper from a longitudinal perspective. As an example, in the embodiment of FIGS. 11–15, the channels 30 taper from maximum width and depth in the center to zero at the tip and tail. The channel 30 can be formed as wide as the ski, for example, being essentially open under the boot binding. In an alternate embodiment envisioned for recreational type skiers, the channels 30 may have maximum depth at the ends, for improving the bite at the tip and tail, while the running surface 40 area under the boot binding remains flat with the edges 50.

Specific shapes of the ski edges 50 can be used to optimize performance over a wide range of conditions. For example, a broad angle chisel edge, like that of FIG. 10A or 10D, will have almost as good grip and bite on ice as the narrow angle chisel edge of FIG. 10B, but may perform better on soft packed snow by not sinking as deep into the surface.

Curved channel 30 and edge tip 54 profiles can also be employed to achieve optimum performance under a wider variety of conditions. For example, FIG. 10C displays a circular/parabolic profile that exhibits the narrow angle chisel point of FIG. 10B, combined with the shallow upper profile of the broad angle chisel of FIG. 10D. A ski 20 with such an edge profile will have the tenacious grip and bite of a narrow chisel edge, while also performing optimally in soft packed snow.

The variety of edge 50 and channel 30 profiles is manifold. The profiles include extremely broad angles and shallow recesses which will perform well under soft and slushy conditions, but which still retain significant grip enhancement on hard packed and icy surfaces. Further, various regions of the ski length may include different profiles of this invention with regard to channel width, depth, profile as well as edge width, angle, and profile.

In this invention, longitudinal transitions in recess or channel 30 depth preferably occur gradually with slopes or curvatures similar to those at the front tip of a conventional ski. The smooth, sloped transitions work to prevent the skis 20 catching on the snow and preventing smooth movement.

FIGS. 11–15 display yet another embodiment of the ski 20 in which smooth transitions between the channel 3 and running surfaces 40 are needed. In this embodiment, the channel 30 is formed as an elongated "X" shape, with the largest portion positioned about beneath the region of the boot binding 20. The running surface 40 gradually fills in the center of channel 30 to produce separate channels 30 on each side of the ski 20 at each end.

Figure 13:
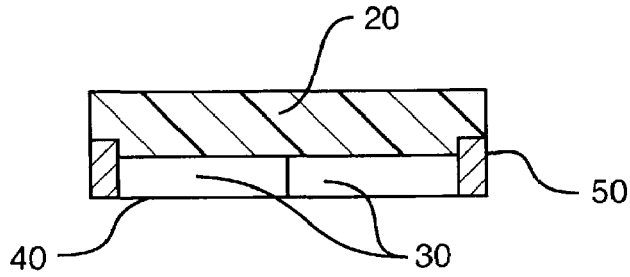
FIG. 13 is an end sectional view of the ski of FIG. 11 taken along line 13—13.
Figure 14:
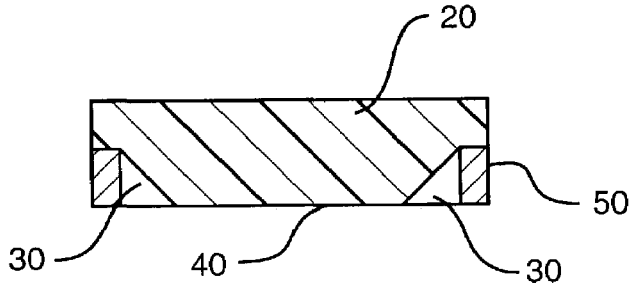
FIG. 14 is an end sectional view of the ski of FIG. 11 taken along line 14—14.
Figure 15:
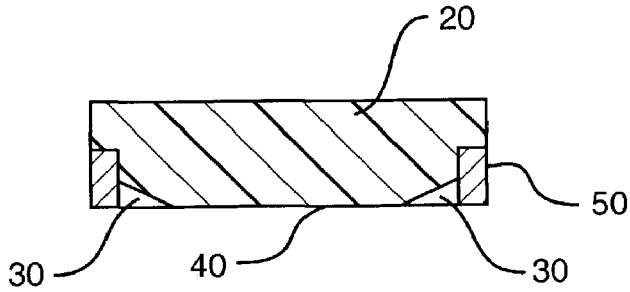
FIG. 15 is an end sectional view of the ski of FIG. 11 taken along line 15—15.

FIGS. 13–15 demonstrate how the channel 30 gradually decreases in size with an increase in distance from the center of the channel 30. The smooth and gradual transition provides good edge control and positive engagement with the snow in use. It should be noted that although this embodiment illustrates the use of one particular style of edge and channel shape, any of the edges 50 and channels 30 shown in, for example, FIGS. 10A to 10D could be used instead. That is the different sections of channel 30 may have rounded side corners, or the ski edge 50 can have a narrow chisel shape like that of FIG. 10B.

The ski equipment design herein dramatically improves edge grip in all situations. The recreational skier will have significantly greater control while skidding due to the greater range of frictional forces. Most significantly, it is now possible for the recreational skier to experience the carved turn that was previously only achievable by a strong, highly trained athlete. All this can be accomplished with little effort in the manner of ice-skating. This invention also applies to snow gliders, where it will significantly improve the already excellent edge engagement design.

While a specific embodiment of the invention has been shown and described in detail to illustrate the application of the principles of the invention, it will be understood that the invention may be embodied otherwise without departing from such principles.

What is claimed is:

1. A ski exhibiting improved control in icy and hard packed snow skiing conditions, comprising:

a ski body having a tip, a tail, ski sides, and a boot binding region, a lower surface of the ski body forming a planar running surface for contacting a skiing surface;

ski edges extending along each ski side of the ski body adjacent the running surface between the tip and tail, one surface of each ski edge being an outer side that is exposed along the ski side, and a second surface that lies substantially in the plane defined by the planar running surface, for contact with the skiing surface when the running surface is flat on the skiing surface;

at least one recessed area forming at least one channel in the running surface, the channel extending alongside and parallel to at least one of the ski edges of the ski for at least part of the length of the ski body to expose an inner side surface of the ski edge.

2. A ski according to claim 1, wherein the at least one recessed area is two recessed areas, one recessed area on each side of the ski body between a non-recessed portion of the running surface and one of the ski edge inner side surfaces.

3. A ski according to claim 2, wherein the two recessed areas are located beneath the boot binding region.

4. A ski according to claim 3, further comprising a third recessed area in the running surface between the ski edges located between the boot binding region and one of the tip and the tail.

5. A ski according to claim 4, further comprising a fourth recessed area in the running surface between the ski edges located-between the boot binding region and the other one of the tip and the tail from where the third recessed area is located.

6. A ski according to claim 1, wherein the inner side surface and outer side surface of the ski edge in the recessed areas from a blade edge with flat edge tips.

7. A ski according to claim 1, wherein the inner side surface and outer side surface of each ski edge in the recessed areas form a blade edge with pointed edge tips.

8. A ski according to claim 1, wherein the running surface extends through the center of at least a portion of the channel, dividing the channel.

9. A ski according to claim 1, wherein the channel is formed as an elongated "X" shape in the running surface.

10. A ski having improved turning and control in icy or hardpack snow conditions, the ski comprising:

a ski body having a tip, a tail, ski sides, and a boot binding region, a lower surface of the ski body forming a planar running surface for contacting a skiing surface;

ski edges extending along each ski side of the ski body adjacent the running surface between the tip and tail, one surface of each ski edge being an outer side, at least a portion of an inner side of one of the ski edges being exposed to the skiing surface, the exposed inner side and corresponding outer side forming an edge tip that lies substantially in the plane defined by the planar running surface, for contact with the skiing surface when the running surface is flat on the skiing surface.

11. A ski according to claim 10, wherein the edge tips have a flat bottom surface.

12. A ski according to claim 10, wherein the edge tips are chisel-shaped.

13. A ski according to claim 10, wherein the edge tips are formed under the boot binding region.

14. A ski according to claim 10, wherein at least a portion of the running surface is continuous all along its length between the tip and tail.

15. A ski according to claim 10, wherein the inner sides of the edges are exposed by at least one recess formed in the running surface.

16. A ski according to claim 15, wherein the at least one recess is an elongated "X" shaped recess.

17. A ski according to claim 15, wherein the at least one recess is a pair of recesses.

18. A ski according to claim 10, wherein edge tips are formed in at least three locations on each edge.

19. A ski according to claim 18, wherein edge tips are formed under the boot binding region, between the boot binding region and the tip and between the boot binding region and the tail.

20. A ski according to claim 18, wherein the three locations are discrete from each other.

* * * * *